US005167125A

United States Patent [19]

Agrawal

[11] Patent Number: 5,167,125

[45] Date of Patent: Dec. 1, 1992

[54] RECOVERY OF DISSOLVED LIGHT GASES FROM A LIQUID STREAM

[75] Inventor: Rakesh Agrawal, Allentown, Pa.

[73] Assignee: Air Products and Chemicals, Inc., Allentown, Pa.

[21] Appl. No.: 681,833

[22] Filed: Apr. 8, 1991

[51] Int. Cl.[5] ..... F25J 3/02

[52] U.S. Cl. ..... 62/24; 62/42

[58] Field of Search ..... 62/23, 24, 29, 11, 32, 62/42

[56] References Cited

U.S. PATENT DOCUMENTS

| | | | |
|---|---|---|---|
| 3,260,058 | 7/1966 | Ray et al. | 62/23 |
| 3,269,130 | 8/1966 | Cost et al. | 62/30 |
| 4,332,598 | 6/1982 | Antonas et al. | 62/29 |
| 4,400,188 | 8/1983 | Patel et al. | 62/13 |
| 4,464,188 | 8/1984 | Agrawal et al. | 62/13 |
| 4,594,085 | 6/1986 | Cheung | 62/29 |
| 4,675,030 | 6/1987 | Czarnecki et al. | 55/16 |
| 4,701,200 | 10/1987 | Fisher et al. | 62/27 |
| 4,758,258 | 7/1988 | Mitchell et al. | 62/25 |

FOREIGN PATENT DOCUMENTS 1360323 3/1984 France .

*Primary Examiner*—Ronald C. Capossela

*Attorney, Agent, or Firm*—Russell L. Brewer; James C. Simmons; William F. Marsh

[57] ABSTRACT

This invention relates to an improved distillation process for recovering exceptionally light gases, e.g. hydrogen, neon, and helium from gas streams containing higher boiling components, e.g., nitrogen and $C_{1-2}$ hydrocarbons. The improvement resides in partially condensing a vapor obtained from a top section in a distillation system thereby concentrating light gases in a vapor phase and concentrating heavier components in the liquid phase. The uncondensed vapor phase rich in light gases is separated from the condensed phase and recovered as product or processed further to further concentrate the light gases. In addition, at least a portion of feed which is to be introduced to the column is cooled against liquid in a bottom section of the distillation system of the column to generate boilup and remove essentially all traces of light gases from the liquid. A purified liquid substantially free from light gases is removed from the bottom of the column.

3 Claims, 2 Drawing Sheets

RECOVERY OF DISSOLVED LIGHT GASES FROM A LIQUID STREAM

FIELD OF THE INVENTION

This invention relates to a cryogenic process for the recovery of low boiling light gases from a gas stream containing low boiling and higher boiling gases.

BACKGROUND OF THE INVENTION

The recovery of low boiling gases such as hydrogen, helium and neon from gas mixtures containing both low boiling and higher boiling gases such as nitrogen, oxygen, argon, $C_{1-2}$ hydrocarbons, carbon monoxide, krypton, and xenon are well known and have been widely practiced in the art. Examples of feed streams containing hydrogen, helium or neon for recovery from higher boiling gas include gases from nitrogen rejection units used to recover to $C_{1-2}$ hydrocarbons from natural gas streams, nitrogen from air and carbon monoxide production from synthesis gas. Representative patents which describe various processes for the recovery of the low boiling light gases from higher boiling gases include the following:

U.S. Pat No. 3,269,130 discloses a process for the separation of gaseous mixtures for generating hydrogen and nitrogen streams which then may be used for the synthesis of ammonia. The high boiling components are separated from the low boiling nitrogen and hydrogen components by charging a cooled liquid to a conventional scrubbing column equipped with vertically disclosed plates. A scrubbing liquid which comprises deeply subcooled nitrogen is introduced to the top plate of the scrubbing column wherein a gas mixture rich in the low boiling hydrogen-nitrogen components is generated. Liquid is withdrawn from the bottom of the column and contains the high boiling component and scrubbing liquid.

U.S. Pat No. 4,675,030 describes a variation to the cryogen processes for recovering helium and nitrogen. A gas mixture containing helium and higher boiling components such as carbon dioxide is cooled to remove water therefrom and then charged at superatmospheric pressure to a helium-permeable, oxygen/nitrogen-impermeable membrane. The permeate contains substantially pure helium. The impermeate, because it still contains some helium, is fed to a second membrane system. The permeate from the second membrane which contains some helium is recycled as feed to the first substantially helium-permeable, oxygen/nitrogen-impermeable membrane. The impermeate then is rejected from the system.

U.S. Pat No. 3,260,058 discloses a cryogenic process for the recovery of helium from gases. The process is representative of some of the early processes for recovering a low boiling gas such as helium from a nitrogen containing stream. In that process, fuel gas or residue gas containing helium is cooled and then passed to a series of flash columns stacked one on top of each other. A cooled feed is charged to a first flash column wherein liquid and vapor are generated. Liquid is taken from the bottom of the flash column, expanded and charged to an intermediate portion of a second adjacent flash column. The vapor fraction from the first flash column is removed and let down in pressure. The liquid from the bottom of the second flash column is expanded and charged to the third flash column which sits atop of the second column. The vapor fraction from the second flash column is removed and expanded and combined with the vapor fraction from the first column. The process is repeated for flash columns 3, 4, 5, and so on wherein the liquid from the bottom of the next adjacent column is expanded and charged as feed to the next adjacent column. Although the process is effective for generating and recovering low boiling gases such as helium or hydrogen with high recovery, it suffers a power penalty because of the repeated expansions and liquefaction steps required to effect separation and concentration of the light components.

French Patent 1,360,323 discloses a process for recovering helium from gas mixtures comprised principally of nitrogen and methane. The separation is accomplished by generating liquid fractions which are then separated from the residual gas fractions enriched in helium. The residual gas fractions are reliquified to eliminate residual nitrogen. Liquefaction of the residual gas enriched in helium is effected by condensation with liquid nitrogen under low pressure. Final purification of the helium is obtained by passage and contact with an adsorbent mass at low temperature.

U.S. Pat No. 4,701,200 discloses a process for recovering helium gas from a nitrogen rejection unit. In the process a gas mixture containing nitrogen, methane and helium is cooled, expanded and charged to a high pressure column wherein a liquid and/or vapor fraction are formed. The vapor fraction is partially condensed and the resulting liquid fraction is separated in a phase separator. The vapor fraction obtained from the separator is again partially condensed and the vapor fraction separated from the liquid fraction in a second separator. That vapor fraction is then warmed against process streams and charged to a pressure swing adsorption unit for further purification. The liquid from the high pressure column is expanded and charged as feed to a low pressure column. Crude liquid from the low pressure column is warmed against the vapor stream obtained from the high pressure column in order to effect partial condensation. The phases are separated. The liquid is pumped to a higher pressure and the vapor then is charged to the bottom of the low pressure column as feed. An overhead vapor stream is taken from the low pressure column and it comprises essentially nitrogen.

U.S. Pat. No. 4,758,258 discloses a cryogenic process for separating helium from helium-bearing natural gases. To accomplish this separation, a series of steps effecting removal of boiling components is performed. A partially condensed natural gas feed is introduced to a first fractionation zone wherein a vapor phase comprised predominantly of helium and nitrogen and a liquid phase containing higher boiling hydrocarbons are obtained. The vapor phase from this column is partially condensed and then introduced into a second fractionation zone wherein a second vapor phase comprised essentially of helium and nitrogen is generated. At this stage essentially all of the hydrocarbons have been removed from the second vapor stream. This process is repeated several times removing any residual amounts of methane and thereby concentrating the helium in the vapor phase.

SUMMARY OF THE INVENTION

This invention relates to an improved cryogenic process for the recovery of low boiling gases from a gas mixture containing both low boiling and higher boiling components wherein a gaseous mixture comprising low boiling light gases selected from the group consisting of hydrogen, helium and neon and high boiling gases which comprises $C_{1-2}$ hydrocarbons, nitrogen, oxygen, argon, carbon monoxide, krypton, and xenon. In the basic process the gas stream is compressed, freed of condensible impurities, and cooled generating a feed for cryogenic distillation in a distillation system which concentrates high boiling components as a bottoms and the low boiling components as an overhead, the improvement for producing light gases in high purity at high recoveries comprises:

a. cooling at least a portion of the feed to the first column in a boiler/condenser wherein a portion of the crude liquid at the bottom of said first column is vaporized;
b. removing the resulting cooled feed from the boiler/condenser;
c. expanding the thus cooled feed and introducing the expanded feed to a middle portion of the first distillation column;
d. generating a vapor fraction containing said low boiling light gases near the top of the first column and a crude liquid fraction at the bottom of the first column;
e. removing at least a portion of the vapor fraction within said first column;
f. partially condensing at least a portion of the vapor fraction generated in step (e), thereby forming a condensed fraction and an uncondensed fraction concentrated in said low boiling light gases;
g. removing at least a portion of the uncondensed fraction concentrated in said low boiling light gases as a product stream;
h. returning at least a portion of the condensed fraction generated in step (e) as a reflux to said first column; and
i. removing a portion of the crude liquid fraction from the bottom of the first column., and recovering refrigeration therefrom.

Advantages of the process of this invention include the following:

an ability to recover low boiling light gases from a mixture containing higher boiling components at high recoveries and at high concentrations;

an ability to recover low boiling light gases from a pressurized gas mixture containing higher boiling components with reduced pressure drop of the incoming feed stream thereby minimizing energy costs; and, an ability to recover low boiling components from gas mixtures containing higher boiling components utilizing relatively simple process equipment thereby minimizing capital costs.

DRAWING

DETAILED DESCRIPTION OF THE INVENTION

Figure 1:
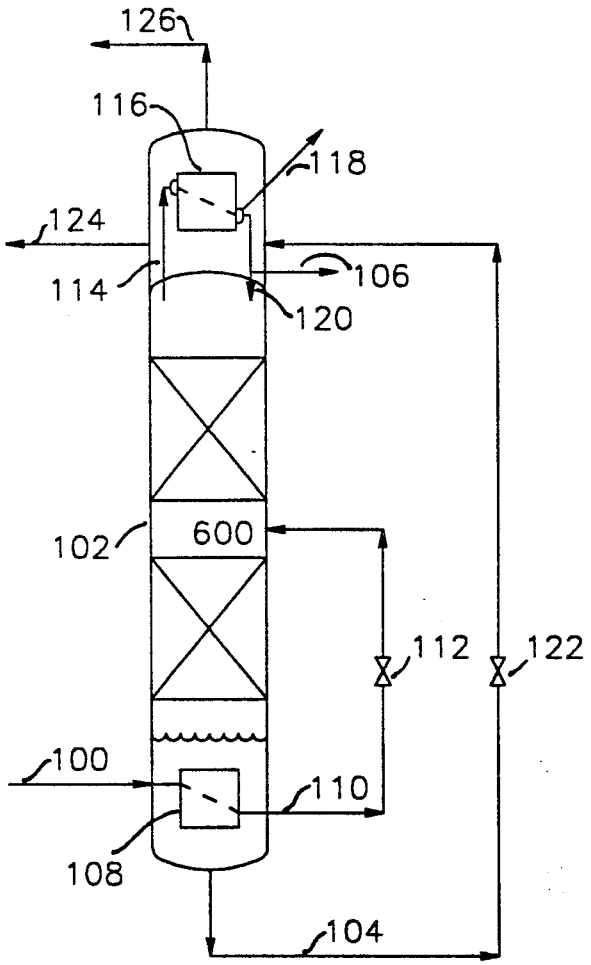
FIG. 1 is a schematic representation of a distillation system in a cryogenic process for the concentration of light or low boiling components from a gas mixture.

Referring to FIG. 1, an inlet feed stream is charged via line 100 to a first distillation column 102. The feed stream may be any stream containing low boiling light gases, e.g. components having a boiling point of from −240° to −269° C. at atmospheric pressure and higher boiling gaseous components, e.g. those components having a boiling point ranging from −50° to −200° C. at atmospheric pressure. Representative feedstreams suited for the recovery of low boiling components such as helium, hydrogen, or neon from higher boiling components include natural gas streams contaminated with nitrogen as for example those obtained from a nitrogen rejection unit in secondary and tertiary recovery, synthesis gas stream containing large quantities of hydrogen and carbon monoxide; and air streams wherein neon and hydrogen are recovered from the nitrogen component of air.

The inlet feed stream is partially condensed or subcooled in boiler/condenser 108 located in the bottom of distillation column 102. Typically this feedstream to boiler/condenser 108 is at high pressure, e.g., 50 to 1,000 psig and at a temperature such that the feed is in the liquid state. Although feedstreams which are gaseous or two phase may be utilized, it is preferred that the feed be substantially in the liquid state so that on cooling in boiler/condenser 108 it becomes subcooled and all of the stream can be expanded and charged to an intermediate portion of the column. If a gas phase is present in the feedstream, not all of the stream may be condensed in boiler/condenser 108 and one incurs greater energy loss due to pressure reduction through valve 122. Alternatively if a two phase stream is present a cooled feedstream exiting boiler/condenser 108 via line 110 can be charged to a phase separator wherein the liquid is separated from the vapor stream. The liquid then can be expanded in JT valve 112 and introduced to an intermediate point in distillation column 102. The vapor stream then is returned to the process for further processing (by means not shown). On the other hand, a two phase stream may be separated wherein the liquid is then introduced via line 100 to boiler/cooler 108 rather than introducing the entire two phase system to boiler/condenser 108. In distillation column 102 low boiling components in feedstream 100 are separated from the higher boiling components such as $C_{1-2}$, hydrocarbons, oxygen, nitrogen, krypton, xenon, and carbon monoxide. To effect separation, distillation column 102 is equipped with a vapor-liquid contacting support such as trays or packing for generating a vapor fraction rich in volatile components within a top section of column 102 and a crude liquid fraction in the bottom portion of column 102. Crude liquid can be removed from the bottom of column 102 via line 104 and a product liquid overhead stream is removed via line 106.

A boiler/condenser 108 is positioned in a lower section of distillation column 102 wherein the incoming feedstream is cooled to a reduced temperature. The act of cooling the feedstream in boiler/condenser 108 provides boilup in the bottom of the column and removes any dissolved low boiling components from the liquid fraction in the bottom of the distillation column. The thus cooled feed is removed from boiler/condenser 108 via line 110, expanded in JT valve 112 and then introduced to an intermediate section of distillation column 102 for separation of the low boiling components from the higher boiling components.

A vapor fraction rich in low boiling, light gases is removed via line 114 from the top section of distillation column 102 and charged to boiler/condenser 116 which is in heat exchange relationship with the top section of distillation column 102. The vapor stream from the top section of distillation column 102 is partially condensed in boiler/condenser 116 thereby generating an uncondensed fraction highly concentrated in low boiling light gaseous components and a condensed fraction having a higher fraction of the higher boiling components. At least a portion of the uncondensed vapor fraction rich in light gases is removed via line 118 and a portion may be recovered as the product or, if further purification of the gas stream is required, then the low boiling light gases can be sent to polishing sections normally associated with cryogenic processes for light gas component recovery.

At least a portion of the condensed fraction generated in boiler/ condenser 116 is returned to the top section of distillation column 102 via line 120 as reflux. A portion of that condensed fraction may be recovered as product via line 106, although in many cases it is preferred that no product, other than light gaseous components, is taken via line 118 at this stage of the process. If product were taken via line 106, it generally would be subjected to further reduction in pressure and fractionation for purification.

Refrigeration for this distillation column is provided by removing the liquid fraction from the bottoms of distillation column 102 via line 104 and expanding that liquid fraction in JT valve 122. The subcooled fraction is conveyed to the vaporizer side of boiler/condenser 116 for effecting partial condensation of the vapor removed via line 114 from the top section of the column. Not all of the liquid fraction introduced via line 104 may be vaporized in the condensation process effected in boiler/ condenser 116. Any residual liquid is removed via line 124 and warmed against process streams. The vaporized fraction is removed via line 126 as a purge or for further processing.

Polishing systems for recovering low boiling light gaseous components in high purity from the uncondensed vapor obtained via line 118 are known. Representative polishing systems include further distillation columns, wherein the process repeated in distillation column 102 is effected in the additional column, or the gas mixture may be treated via a pressure swing adsorption unit wherein the low boiling components are recovered as products. Membrane units may also be utilized.

Further embodiments of the process are contemplated without limiting the scope. For example, the rectifying section in the distillation column 102 may be a dephlegmator wherein upflowing vapor is condensed with the downward flowing liquid acting to scrub higher boiling components from the vapor stream. In yet another alternative, a supplemental heat source could also be used to provide more boilup at the bottom of the distillation column 102.

Figure 2:
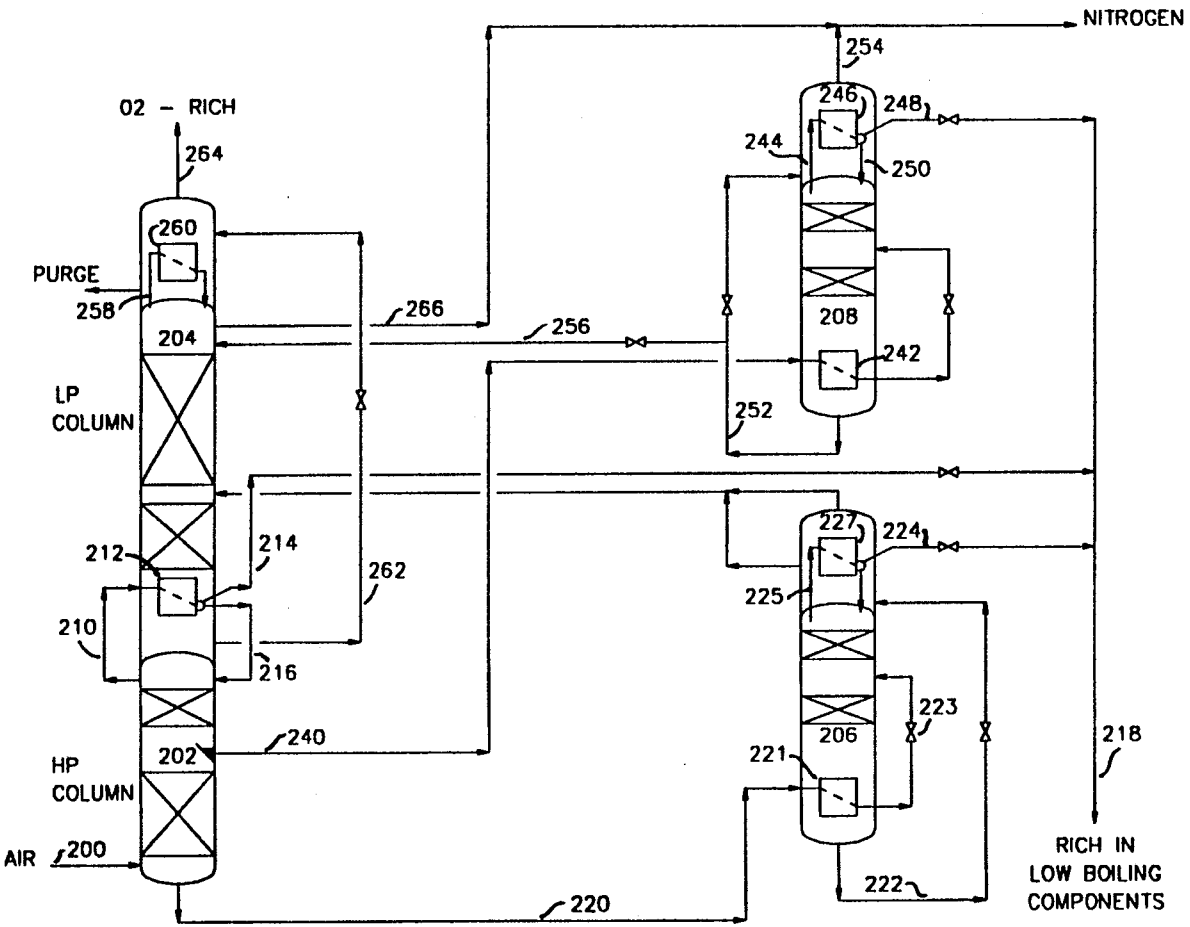
FIG. 2 is a schematic representation of a cryogenic process for the separation of air while concentrating neon, hydrogen and helium components.

FIG. 2 is a schematic representation of an embodiment for the recovery of hydrogen, helium and neon from an air stream. The air stream typically contains approximately 18 ppm neon, 0.5 to 10 ppm hydrogen, and 5 ppm helium. The flow scheme utilizes a multicolumn distillation system comprising a high pressure column 202, a low pressure column 204, and a first auxiliary column 206 and second auxiliary column 208.

In this process air which has been cooled and freed of condensible impurities is introduced via line 200 to a bottom section of the high pressure column 202 for separation of the air stream into its components. In high pressure column 202 a crude liquid oxygen stream is generated near the bottom and a nitrogen rich vapor stream contaminated with volatile components is generated in the top section. A nitrogen rich vapor is removed from the top section of high pressure column 202 via line 210, wherein it is partially condensed in boiler/condenser 212 located within a bottom section of low pressure column 204. The uncondensed phase is removed via line 214 and the condensed phase is removed via line 216 and returned to the top section of high pressure column 202 as reflux. The uncondensed phase in line 214 is highly concentrated in low boiling components e.g., hydrogen, neon, and helium.

A crude liquid oxygen fraction containing dissolved low boiling impurities is removed via line 220 and charged to boiler/condenser 221 and the bottom of first auxiliary column 206. The introduction of the crude liquid oxygen as feed to boiler/condenser 221 provides boilup in first auxiliary column 206 and effects removal of low boiling gases which are dissolved in the liquid phase descending to the bottom section. The subcooled liquid is withdrawn from boiler/condenser 221 decreased in pressure across JT valve 223 and introduced into a middle portion of first auxiliary column 206 for separation.

The low boiling, light components dissolved in crude liquid oxygen stream introduced to first auxiliary column 206 are concentrated as a vapor fraction in the top section. A portion of that fraction is removed via line 225, wherein it is partially condensed in boiler/condenser 227. The uncondensed phase which is extremely rich in the low boiling neon component is removed via line 224, while the condensed phase is returned to auxiliary column 206 as reflux.

Refrigeration for boiler/condenser 227 is obtained by removing the crude liquid fraction from the bottom of first auxiliary column 206 via line 222 and expanding that portion and supplying it to the vaporizer side of boiler/condenser 227. The exhaust from the vaporizer side of boiler/condenser 227 is charged to an intermediate portion of low pressure column 204 as a feed for separation.

Nitrogen liquid is collected at an intermediate point in high pressure column 202 and removed via line 240, wherein it is subcooled in boiler/condenser 242, expanded and charged to an intermediate portion of second auxiliary column 208. A liquid fraction substantially free of dissolved gases is generated at the bottom of second auxiliary column 208 and a vapor fraction rich in low boiling volatile components, i.e., hydrogen, neon and helium is generated within the top section. The vapor fraction is removed via line 244 wherein it is partially condensed in boiler/condenser 246 with the uncondensed phase being removed via line 248 and the condensed phase returned via line 250 as reflux to auxiliary column 208. Partial condensation of the vapor fraction obtained via line 244 leads to a significant concentration of lights in that phase and a reduction in flow in line 248.

Refrigeration for effecting partial condensation in boiler/condenser 246 is supplied by removing liquid from the bottom of second auxiliary column 208 via line 252 and decreasing the pressure of a fraction of this liquid stream in line 252 and charging it to the vaporizer side of boiler/condenser 246. The overhead from vaporizer section is removed via line 254. Refrigeration is recovered by warming the overhead against process streams.

A portion of the liquid fraction from second auxiliary column 208 is removed via line 256 and charged to the top section of low pressure column 204 as reflux. A vapor fraction rich in nitrogen is removed via line 258 from the top section of low pressure column 204, wherein it is totally condensed in boiler/condenser 260. The condensed phase is returned to low pressure column 204 as reflux. Refrigeration for boiler/condenser 260 is supplied by removing liquid fraction from the bottom section of low pressure column 204 via line 262 and expanding that fraction and charging it to the vaporizer side of boiler/condenser 260. The vaporized effluent is removed via line 264. Nitrogen of high purity is removed as a liquid or vapor from the top section of low pressure column 204 via line 266.

In FIG. 2, all the streams 214, 224 and 248 rich in low boiling components are combined to provide a stream 218 which can be further processed to recover light gases such as hydrogen, helium and neon.

Typically, in FIG. 2, the pressures in the distillation columns of the multi-column distillation system are as follows: The high pressure column will have a pressure ranging from about 75 to 300 psia, the low pressure column will have a pressure from about 16 to 90 psia and auxiliary columns 206 and 208 will have a pressure generally intermediate that of high pressure column 202 and low pressure column 204, typically about 5 to 20 psi higher than the low pressure column.

FIG. 2 shows an example where the invention of FIG. 1 is applied to a double column air separation plant through the use of a first auxiliary column 206 and a second auxiliary column 208. If needed only one of the auxiliary columns may be used., for this case use of second auxiliary column 208 will be more preferred as the amount of low boiling components dissolved in liquid stream 240 will be more than that in liquid stream 220. It is clear that the auxiliarly column(s) can be used with any suitable double column air separation distillation scheme to recover dissolved light gases from a liquid stream.

One advantage of the present invention is that the vapor phase generated within the top sections of each of the distillation columns in the multi-column distillation system undergoes substantial concentration of low boiling light components by virtue of the partial condensation of the vapor phase in boiler/condensers associated with that vapor fraction. Partial condensation of the vapor fraction and in removal of the uncondensed phase concentrates the low boiling components in the uncondensed phase and in addition, reduces its flow rate to a substantial degree. The condensed streams obtained from boiler/condensers associated with the partial condensation of the vapor streams are substantially free of the low boiling component and therefore provide excellent reflux feeds for effecting purification of gases within the top section of each of the distillation columns. Lastly, by subcooling feed streams in the bottom sections of at least one of the distillation columns in the multi-column distillation system, the liquid fractions associated with the bottoms of that column are purified to the extent that low boiling dissolved gases are vaporized. Therefore, liquid streams leaving the bottom of the distillation columns have little contamination with dissolved low boiling components. Another advantage of the invention, is illustrated in FIGS. 1 and 2, is that there is very little pressure reduction associated with the concentration of low boiling gases. Because of the combination of stages of subcooling the feedstream and effecting partial condensation of overhead vapor streams, one minimizes pressure losses through multiple expansions associated with the prior art.

What is claimed is:

1. In a process for the cryogenic separation of a gaseous mixture comprising low boiling light gases selected from the group consisting of hydrogen, helium and neon from high boiling gases which comprises $C_{1-2}$ hydrocarbon, nitrogen, oxygen, argon, carbon monoxide, krypton, and xenon wherein the gas stream is compressed, freed of condensible impurities, and cooled generating a feed for a distillation system, the improvement for producing light gases in high purity at high recoveries which comprises:

a. cooling at least a portion of the feed to a first column in a boiler/condenser wherein a portion of the crude liquid at the bottom of said first column is vaporized;

b. removing the resulting cooled feed from the boiler/condenser, c. expanding the thus cooled feed and introducing the expanded feed to a middle portion of the first distillation column;

d. generating a vapor fraction containing said low boiling light gases near the top of the first column and a crude liquid fraction at the bottom of the first column;

e. removing at least a portion of the vapor fraction within said first column;

f. partially condensing at least a portion of the vapor fraction generated in step (e), thereby forming a condensed fraction and an uncondensed fraction concentrated in said low boiling light gases;

g. removing at least a portion of the uncondensed fraction concentrated in said low boiling light gases as a product stream;

h. returning at least a portion of the condensed fraction generated in step (e) as a reflux to said first column; and i. removing a portion of the crude liquid fraction from the bottom of the first column; and recovering refrigeration therefrom.

2. The process of claim 1 wherein a portion of the crude liquid at the bottom of the first column is removed, expanded, and vaporized against the vapor fraction removed from the top section of the first column.

3. The process of claim 1 wherein the feed to the first column is substantially in the liquid phase and that liquid phase is subcooled in boiler/condenser located in the bottom section of the distillation column.

* * * * *